United States Patent [19]

Ignell

[11] 4,387,820

[45] Jun. 14, 1983

[54] CLOSING ARRANGEMENT FOR PACKING CONTAINERS

[75] Inventor: Rolf L. Ignell, Grilly Divonne-les-Bains, France

[73] Assignee: Tetra Pak Developpement SA, Pully-Lausanne, Switzerland

[21] Appl. No.: 279,945

[22] Filed: Jul. 2, 1981

[30] Foreign Application Priority Data

Jul. 16, 1980 [SE] Sweden ..... 8005182

[51] Int. Cl.[3] ..... B65D 41/02

[52] U.S. Cl. ..... 215/320; 215/321; 220/306

[58] Field of Search ..... 215/320, 321; 220/281, 220/306, 315

[56] References Cited

U.S. PATENT DOCUMENTS

Re. 25,906 11/1965 Livingstone ..... 220/307

3,994,410 11/1976 Pirgov et al. ..... 215/320

FOREIGN PATENT DOCUMENTS 2377333 9/1978 France ..... 215/321

*Primary Examiner*—Donald F. Norton

*Attorney, Agent, or Firm*—Burns, Doane, Swecker & Mathis

[57] ABSTRACT

The closing of packing containers, e.g. bottles for beer or refreshing beverages, is achieved by means of metal or plastic caps. A cap which is easy to handle and which is reclosable is disclosed. A substantially conventional cap body of flexible plastic material is provided with locking devices in the form of integrated lever arms, which can be maneuvered by means of a ring surrounding the cap body. The locking devices in closed position rest against a bulge located around the neck of the bottle and can be maneuvered with the help of the ring to an open position in which they permit the unhindered removal or replacement of the cap.

10 Claims, 7 Drawing Figures

CLOSING ARRANGEMENT FOR PACKING CONTAINERS

BACKGROUND AND SUMMARY OF THE PRESENT INVENTION

The present invention relates to closures for containers, and more particularly to flexible closures adapted to be secured on the containers.

Packing containers for liquid contents, e.g. beverage packages of the bottle type, are usually closed with the help of closing arrangements of substantially two types, namely caps which are not deformed when the packing container is opened, and which therefore may be used for reclosing of the same, and caps which are deformed on opening.

Among the firstnamed type are first and foremost the conventional screw cap, which owing to its reclosability continues to be used to a considerable extent, especially on larger packing containers. However, the cap is relatively expensive to make and to apply to the packing container and it is, moreover, often difficult to open, especially for persons with diminished manual strength.

Among the other type of closing arrangements, that is to say closing arrangements which are deformed on opening, is e.g. the crown cap. This cap comprises an axial jacket whose diameter is reduced as it is fitted on, so that the jacket embraces an outwardly directed bulge or flange located at the mouth end of the container neck. When the closing arrangement is to be removed, a special tool is used which widens the jacket again so that it can pass the bulge, and the cap can be removed. In this process the cap is deformed, however, to such an extent that any reclosing becomes quite impossible.

Neither of the two abovementioned types of caps thus fulfills at the same time the demand for good openability and the possibility of reclosing. It is the object of the present invention, therefore, to provide a closing arrangement which meets the abovementioned demand and which, moreover, at a competitive cost produces a closure with satisfactory tightness.

In recent times it has become more and more usual to manufacture packing containers for e.g. carbonated refreshing beverages in the form of plastic bottles of large volume, e.g. one or two liters. These plastic bottles are made with very thin walls and therefore will be inexpensive to manufacture, while, owing to the orientation of the plastic material carried out in connection with the manufacture, they have at the same time sufficient strength to withstand the internal pressure in the bottles. However, the bottles are very susceptible to axial stresses of the type which arises when on a capping machine a cap is to be applied over the emptying opening, and this step therefore must take place at relatively low speed which appreciably limits the capacity of the filling machine. This disadvantage can be partly overcome, in that the packing container is provided with a neck portion of greater wall thickness. This portion has a strong external flange which serves as a holder-up during the capping process. This prevents the container body itself being subjected to axial stresses. However, this is achieved at the expense of an appreciably higher material consumption and greater complexity of the filling machine.

It is a further object of the present invention therefore to provide a closing arrangement which can be applied without the packing container being subjected to any appreciable axial stress and which is especially suitable, therefore, to be used jointly with thin-walled packing containers made of plastics.

It is a further object of the present invention to provide a closing arrangement having maneuverable parts which are displaceable between two distinctive positions, namely an open or inactive position and a closed or active position.

It is a further object of the present invention to provide a closing arrangement which in spite of comprising maneuverable parts is manufactured in one piece of flexible plastic material. Previously known closing arrangements with maneuverable locking devices adapted to co-operate with external bulges, flanges, protruding rims or the like on container necks are made of several different parts, which makes manufacture as well as handling more expensive.

Finally it is also an object of the present invention to provide a closing arrangement whose maneuverable part safely remains in active position during the handling of the packing container, and which at the same time is not affected by the high internal pressure which arises with certain contents.

These and other objects have been achieved in accordance with the invention in that a closing arrangement of the type described in the inroduction has been given the characteristic that each one of the locking devices is constituted of a lever which is suspended so that it can pivot at the lower end of the jacket, and which is moulded in one piece with the jacket as well as with the stiffening ring surrounding the jacket, by means of which the levers can be maneuvered jointly to the active position in which they engage with the external bulge or flange of the packing container and press the closing arrangement against the mouth of the packing container.

Preferred embodiments of the closing arrangement in accordance with the invention have been given, moreover, the characteristics which are described below.

BRIEF DESCRIPTION OF THE DRAWINGS

The closing arrangement in accordance with the invention will now be described in greater detail with special reference to the enclosed drawings which illustrate schematically two different embodiments of the closing arrangement in accordance with the invention and their application to a packing container. To simplify the figures, only the details necessary for an understanding of the invention have been included.

DESCRIPTION OF THE PREFERRED EMBODIMENTS

Figure 1:
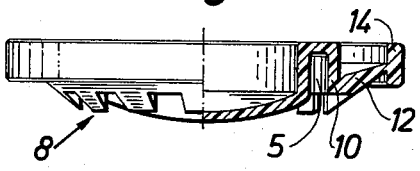
FIG. 1 is a side view partly in section of a closing arrangement in accordance with the invention with the locking devices in inactive position.

The closing arrangement in accordance with the invention comprises a cap body 1 which is substantially circular and has elements for the retaining of the closing arrangement on the mouth portion of the container as well as for the sealing of the emptying opening of the container. The closing arrangement is manufactured from a flexible material, e.g. polyethylene, which possesses the required flexibility and which can be formed in a simple manner to the desired shape by injection moulding.

In order to fulfil its sealing function in an optimum manner when the closing arrangement in accordance with the invention is applied to a mouth portion of a packing container (FIG. 3), the closing arrangement is provided with a recessed center portion 2 which extends somewhat into the mouth portion or emptying portion 3 of the packing container. The outer diameter of the center portion 2 is adapted to the inner diameter of the mouth portion of the packing container for which the closing arrangement is intended, and the center portion thus rests with its outside against the inner surface of the emptying opening. The center portion 2 may possibly have special annular sealing elements in the form of bulges or tongues, but normally this ought not to be necessary, since the center portion 2, thanks to the flexibility of the material, ensures a sufficiently strong sealing function. To ensure maximum tightness, the center portion 2 can be given a diameter which is a little greater than the corresponding inner diameter of the mouth portion, as a result of which a satisfactory sealing pressure is guaranteed at all times. To facilitate the fitting on of the cap, it is possible to shape the emptying opening as well as the center portion so that they have a slight taper. The taper of the center portion must be made a little smaller than the taper of the emptying opening, so that the main sealing pressure is concentrated on an annular area in the vicinity of the lower end of the center portion 2.

Coaxially with the center portion 2, the cap body 1 comprises an external jacket 4 which is concentric in relation to the center portion 2 and is joined to the same at the upper end of the cap body. The jacket 4 is cylindrical or slightly tapering and is situated at such a distance from the outer limiting surface of the center portion 2, that a channel 5, opening downwards, which is formed between them, can receive the upper end of the mouth portion 3 of the packing container 6. The mouth portion 3, as can be seen from FIG. 3, is provided at its upper end with a bulge or flange 7 directed outwards, and the free width of the channel 5 is chosen so, therefore, that it substantially corresponds to the bulge 7.

Figure 2:
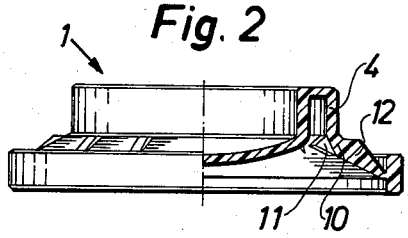
FIG. 2 is a side view partly in section of the closing arrangement in accordance with FIG. 1 with the locking devices in active position.

The retaining device of the closing arrangement comprises a number of locking devices 8 which are arranged around the cap body and moulded in one piece with the same. More specifically, the locking devices 8 comprises a number of levers 9 which are joined to and are pivotable around the bottom end of the jacket 4. Each lever 9 is thus attached to the jacket 4 at a fulcrum 10, which also divides the lever 9 into two lever arms, namely a lever arm 11 directed towards the center of the closing arrangement and a lever arm 12 facing away from the center of the closing arrangement. The lever arm 11 is thus directed towards the mouth portion 3 of the packing container and is adapted so as to engage with the same when the closing arrangement is in its applied position shown in FIG. 3. The lever arm 11 then rests against the packing container at the lower end of the bulge 7 and retains the closing arrangement in position over the mouth portion of the packing container. The lever arm 12 of the lever 9, directed oppositely, is accessible from the outside of the closing arrangement, and is adapted so as to be maneuverable between an open and a closed position, which is illustrated in FIG. 1 and FIG. 2 respectively and will be described in more detail in the following. The lever arms 12 are appropriately mutually joined to a brim 13 of a relatively thin flexible material, and to simplify the simultaneous maneuvering of the levers distributed uniformly along the periphery of the jacket, all the outer ends of the lever arms 12 in turn are joined by means of a stiffening bulge or ring 14 situated at the outer periphery of the brim 13.

The closing arrangement in accordance with the invention can assume two different positions, namely an active position and an inactive position. In the active position the lever arms 11 extend inwards towards the center of the closing arrangement so as to retain the closing arrangement in sealing position by engaging under the external bulge or flange on the mouth portion of a packing container. In the inactive position of the closing arrangement the lever arms 11 extend substantially in the extension of the outer channel wall of the channel 5, that is to say the lever arms 11 extend in downwards direction and leave the channel free, so that the same is fully open and permits application of the closing arrangement onto the mouth portion of the packing container. The maneuvering of the lever arms 11 between active and inactive position takes place with the help of the levers 9 and the stiffening ring 14 located at the outer end of the same, which is maneuverable between two end positions, namely an upper or inactive position (FIG. 1) and a lower or active position (FIG. 2). The brim 13, which mutually joins the lever arms 12, assumes then a conical upwards directed position or a conical, downwards directed position respectively. On being moved between the active and the inactive position, and especially on passing from conicity in one direction to conicity in the other direction, the plastic material in the brim and in the lever arms will be compressed, since the brim is manufactured from relatively thin material compared with the ring 14. This has the consequence that the brim endeavours to remain in one of its end positions, so that a certain stabilizing or self-locking effect is obtained, which not only brings about a guarantee against unintentional maneuvering but also, by a snap effect, facilitates the maneuvering between the different end positions.

Figure 3:
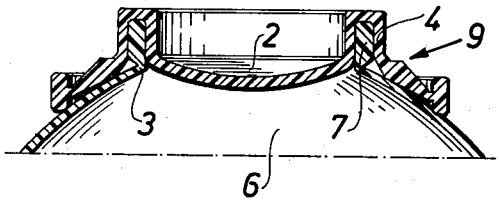
FIG. 3 is a cross sectional view of the closing arrangement in accordance with FIGS. 1 and 2 in applied, active position on a mouth portion of a packing container.
Figure 4:
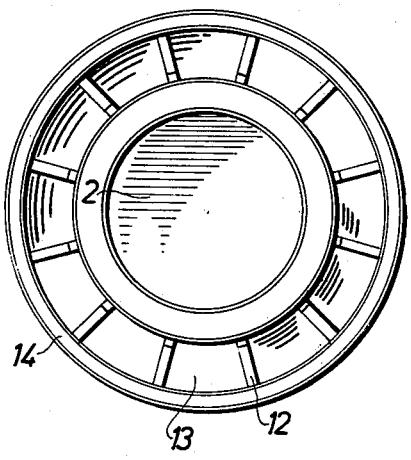
FIG. 4 is a top view of the closing arrangement in accordance with the invention.
Figure 5:
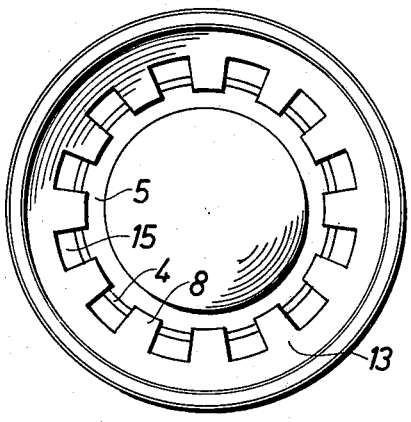
FIG. 5 is a bottom view of the closing arrangement in accordance with the invention.

As can be seen especially from FIG. 3, the channel 5 has a depth which substantially corresponds to the height of the bulge 7 (that is to say the respective dimensions in the axial direction of the closing arrangement), which means that when the closing arrangement is applied and locked, the fulcrum 10 of the lever 9 will be substantially straight opposite the lower edge of the bulge or flange 7. After application of a closing arrangement whose locking device is in inactive position, the ring 14 is maneuvered from the inactive to the active position, in which the ring will rest against the upper shoulder portion of the packing container 6. This means that the levers 9 will be turned to their active position, so that the lever arms 11 are introduced under the lower boundary surface of the bulge 7 and engage with the same. By virtue of the relation, described earlier, between the depth of the channel 5 and the height of the bulge 7, the closing arrangement will be made thereby to rest against the mouth portion 3 and form a seal owing to the center portion 2 being forced down into the emptying opening until the bottom of the channel 5 rests against the outer end of the mouth.

When the closing arrangement in accordance with the invention is to be removed again from the mouth portion 3 of the packing container, the process is reversed, that is to say the ring 14 is raised from its active to its inactive position, the levers 9 being turned around the fulcrum 10 at the lower end of the jacket 4, so that the lever arms 11 are pivoted downward—outwards from their active position underneath the bulge 7, and the closing arrangement can be removed from the mouth portion by continued raising of The ring 14 so that the bulge 7 slides out of the channel 5. After removal from the packing container the closing arrangement is in the inactive position shown in FIG. 1 and can therefore, without any hindrance, be replaced on the packing container and used for reclosing a great number of times.

On application of the reclosing arrangement in accordance with the invention onto a packing container with an external bulge according to FIG. 3, the outer end of the lever arms 11, as has been described, will come underneath the bulge 7. On activation of the locking device of the closing arrangement by pressing down of the ring 14 to the active position, the lever arms 11 are pivoted inwards-upwards against the lower boundary surface of the bulge 7, whereby the fulcrums 10 for each one of the lever arms will come to end up a little below the lower edge of the bulge 7. This movement will force the closing arrangement into a correct position with the bottom of the channel 5 resting against the edge of the mouth portion and with the center portion 2 in sealing contact with the inner surface of the mouth portion, even if the closing arrangement at the start has not been applied correctly, that is to say, has not been pressed down in its correct position. When the closing arrangement is applied to the type of packing container mentioned in the introduction, which is susceptible to the axial stresses arising during the conventional fitting on of the caps, this effect can be made use of inasmuch as the closing arrangement is applied only relatively loosely onto the mouth portion of the packing container, whereupon the maneuvering of the stiffening ring 14 and of the levers 9 is utilized for bringing the closing arrangement into the correct sealing position. In this way the final phase of the closing can be performed by the interplay between the bulge and the lever arms 11, without the packing container being subjected to appreciable axial forces.

As mentioned previously, the tapering brim 13 together with the ring 14 and the lever arms 12 may assume two stable positions, namely an upper and a lower position. The main reason for this is that the closing arrangement, when it is cast, is given the shape shown in FIG. 1, that is to say it is in its inactive position, the brim 13 assuming an upwards directed, conical shape. Since the brim 13 consists of thin plastic material and the stiffening ring 14 is made with considerably larger dimensions, the brim 13, when the stiffening ring 14 is to be moved to its lower position, that is to say when the locking devices 8 are to be moved into their active position, will have to be compressed before it reaches the lower position. The resistance of the brim against this compression creates a stabilizing force which endeavours to retain the brim in either end position. When the stiffening ring and the brim are moved against the effect of this force the stiffening ring, after the force has been overcome, will snap into its new position, which facilitates appreciably the maneuvering of the closing arrangement in accordance with the invention. When the closing arrangement has been applied onto the packing container, the stability of the locking devices in the locked position will be further improved by the fact that the length of the lever arm 11, that is to say the distance from the fulcrum 10 to the end of the lever arm, is greater than the distance between the said fulcrum and the point of application of the lever arm on the packing container directly underneath the bulge 7. This relationship forces the jacket 4 to be bent outwards a little, that is to say stretched somewhat in peripheral direction, when the lever arm 11 passes from the inactive to the active position. In this way a "toggle-joint effect" is produced which locks the closing arrangement and its retaining device in the active position. The said effect can be controlled, not only by adapting the length of the lever arm 11 in relation to the available space, but also by the choice of material, thickness of the jacket and taper angle.

As is evident from the figures, the two lever arms 11 and 12 of the levers 9 are of different length. This difference in length may vary within wide limits, but is appropriately chosen so that the lever arm 11 directed towards the packing container has a length which corresponds to approx. ¼ of the lever 9. This relation ensures an easily maneuverable locking arrangement at the same time as the lever arm 11 is given sufficient strength to force the closing arrangement into the right position, even if it has not been pressed down fully into its correct position when applied to the mouth portion of the packing container.

The brim 13 and the levers 9 joined to the brim are moulded in one piece, and in order to reduce the material consumption in the manufacture of the closing arrangement it is appropriate to mould the brim of relatively thin material and mould the layer arms as integrated, stiffening parts of the brim. Since the lever arms 12 are placed straight in front of the lever arms 11, the forces arising on activation of the closing arrangement will be transmitted directly to the stiffening ring 14 which is given dimensions such that it remains largely unaffected by the normally arising forces. Intermediate portions of the brim 13 are not subjected to any appreciable stresses and can be made very thin which is an advantage, since the attachment of the brim e.g. in the stiffening ring becomes flexible as a result, so that the maneuvering is not hindered or negatively influenced. Moreover, it may be appropriate wholly or partly to remove the intermediate portions of the brim 13, since in this manner on the one hand a further saving of material is achieved, and on the other hand a further improvement of the maneuverability of the locking device is obtained. Thus the brim 13 can be provided with a number of openings 15 on its inner part facing towards the jacket 4, so that the connection with the jacket 4, serving as a hinge or fulcrum 10, is provided through the said openings with interruptions of a combined length of substantially half the circumference of the jacket. As a result the brim will be joined to the jacket exclusively at the fulcrums 10 of the levers. If the brim 13 is altogether designed so that the lever arms 12 constitute the only connection between the jacket 4 and the stiffening ring 14, the stiffening ring 14 may also be moulded as a polygon with straight portions between the points of attachment of the lever arms.

Figure 6:
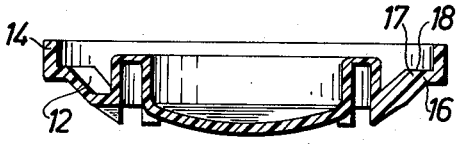
FIG. 6 corresponds to FIG. 1, but is a cross sectional view of a modified embodiment of the closing arrangement in accordance with the invention.
Figure 7:
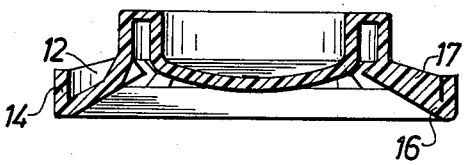
FIG. 7 corresponds to FIG. 2, but is a cross-sectional view of the modified embodiment in accordance with FIG. 6.

A particularly advantageous embodiment (FIGS. 6, 7) of the closing arrangement in accordance with the invention can be achieved by a certain modification of the levers 9 as well as of the connections between these and the stiffening ring 14. Thus without any appreciable increase in material consumption a more stable and more distinctly maneuverable closing arrangement is obtained in that the lever arms 12 directly adjoining this thin junction point serving as a hinge 16, are provided with an upwardly directed projection 17. The projection 17 comprises a plane working surface 18 which in the inactive position of the lever 9 extends at a right angle to the center line of the closing arrangement, so that in the active position it extends substantially parallel with the center line and rests against the inside of the closing ring 14. By this the stability of the stiffening ring is improved at the same time as its movement is limited, so that a distinct end position for the movement of the levers (of the brim) is created. To maximize the stabilizing effect, it is advantageous to place the junction points or hinges 16 (between the levers 9 and the stiffening ring 14) at the lower edge of the internal cylindrical surface of the stiffening ring, so that the contact surface between the projection 17 and the stiffening ring becomes as long as possible, seen in axial direction of the closing arrangement. Thanks to the contact between the stiffening ring 14 and the lever arms 12 the lever arms are prevented from being bent upwards or deformed in some other manner by the forces which arise owing to the internal pressure in the packing container and which via the jacket 4 is transmitted to the levers. At the same time the stiffening ring supports the levers so that the lever arms 11 remain in safe engagement with the mouth portion of the packing container.

To prevent unintentional opening through internal pressure or external influences it is essential that the stiffening ring is given such dimensions that it has to be "stretched" (or rather the levers have to be compressed) during maneuvering of the levers between the different positions. When the ring is unstressed, the diameter of the stiffening ring should be somewhat smaller than the diameter of the imaginary circle which is formed by the hinges between the stiffening ring and the levers when these, during the maneuvering between the different end positions, pass a position at a right angle to the center line of the closing arrangement, that is to say, when the hinges of two diametrically opposite levers are at a maximum distance from one another. To utilize to the greatest possible extent the support from the projection of the lever arms it is advantageous, furthermore, to give the stiffening ring such a diameter that thanks to its inherent elasticity it is given a certain initial stress, since in the closed position of the closing arrangement it rests against the projection of the levers, that is to say the diameter of the stiffening ring is smaller in the unstressed, open position of the closing arrangement than in its closed position.

Owing to the projection of the levers and the contact between these and the inside of the stiffening ring, the levers are prevented from being bent upwards in the area between the point of application on the top of the packing container and the connection with the stiffening ring when the internal pressure in the packing container endeavors to lift the center portion of the closing arrangement. Since the stiffening ring may be considered as practically unyielding to the stress from each individual lever, any tendency towards bending upwards of the lever will be effectively prevented through the contact of the projection with the upper part of the stiffening ring, which implies an effective locking of the closing arrangement in active position. When the closing arrangement is to be removed from the packing container, the projection does not act as a hindrance, since at the manual lifting of the stiffening ring the levers are turned in opposite direction, that is to say the projection is removed from the stiffening ring.

Since the intermediate portions of the levers are wholly separated from each other or are only joined by means of a very thin and flexible brim, no forces, or only insignificant ones, arise at a right angle to the levers during maneuvering of the closing arrangement which proves to be an appreciable advantage compared with earlier embodiments wherein the brim was of uniform thickness. The material accumulation in the brim then gave rise to inner tensile and compression stresses in the brim which rendered maneuvering more difficult and produced less distinct end positions. The material which is present in the stiffening ring, in spite of its relatively strong dimensions, is not subjected to corresponding stresses, since the ring is "parallel-displaced" between its end positions without the rotary movement of the levers affecting the ring, as the attachments or hinges between the levers and the stiffening ring are very flexible and thin (approx. 0, 2 mm).

The versions of the closing arrangement which have a whole or uninterrupted brim, which with its outer stiffening ring in the active or closed position rests against the upper shoulder portion of the packing container, will automatically protect a portion of the packing container situated around the emptying opening against touch and dirtying during handling of the opened packing container. This protection against touch is valuable for hygienic reasons, since it produces a clean surface around the emptying opening which is especially valuable if the consumer drinks directly from the packing container.

As is evident from the description, the closing arrangement in accordance with the invention can be manufactured in one piece which facilitates the handling as well as the mechanical fitting of the caps. The absence of loose parts in the form of rings, sealing washers etc. makes the closing arrangement, moreover, particularly suitable for automatic manufacture. Finally, the closing arrangement is very sturdy and can be used a great number of times for reclosing without its function being impaired, since neither the maneuvering nor the removal and application subject the closing arrangement to any major stresses.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. A closure cap for a packing container of the type which has a flanged mouth portion, said cap comprising:

a cap body of flexible material;

a jacket integral with said body and cooperating therewith to form a channel for receiving the flanged mouth portion of a container;

a plurality of levers spaced around said jacket and integral with said jacket, said levers each including a first lever arm positioned to engage under said flanged mouth portion when said levers are lowered and positioned out of engagement with said mouth portion when said levers are raised, each of said levers further including:

first pivoting means around which said lever is pivotable, said first lever arm being disposed on a first side of said first pivoting means and said first lever arm cooperating with the flanged mouth portion of the packing container, a second lever arm disposed on a second side of said first pivoting means, said second lever arm serving as a stiffening element, and second pivoting means around which said lever is pivotable; and ring means for moving said levers in unison between said lowered and raised positions, said second pivoting means joining each of said levers to said ring means.

2. The closure cap of claim 1 wherein said ring means includes a stiffening ring which is situated in a plane above said first lever arms when said levers are raised and wherein said stiffening ring is situated in a plane below said first lever arms when said levers are lowered.

3. The closure cap of claim 2 wherein said stiffening ring has a smaller diameter when said levers are raised than when said levers are lowered and wherein said stiffening ring must be radially expanded during a middle portion of its travel as said levers are raised and lowered thereby urging said cap body into one of the two positions.

4. The closure cap of claim 1 wherein each of said second lever arms has a plane surface which is in a substantially horizontal orientation when said lever arms are raised, said plane surface being in a substantially vertical orientation and resting against an inside periphery of said stiffening ring when said lever arms are lowered.

5. The closure cap of claim 1 wherein said levers are uniformly distributed around said jacket and wherein said levers are mutually joined by a thin conical brim said second lever arms being integrated stiffening parts of said brim.

6. A closure cap for a packing container of the type which has a flanged mouth portion, said cap comprising:

a cap body of flexible material;

a jacket integral with said body and cooperating therewith to form a channel for receiving the flanged mouth of a packing container;

a plurality of locking levers integral with said jacket and spaced around said jacket, each of said levers having a first lever arm, a fulcrum and a second lever arm, said second lever arm being pivotably attached at a first end by said fulcrum to said jacket;

a stiffening ring encircling said jacket and being integral therewith, a second end of each of said second lever arms being pivotably attached by a hinge to said stiffening ring; and wherein said first lever arms are pivotable around said fulcrum between a lowered position during which said first lever arms are upwardly oriented, and cooperate with and rest against the flanged mouth portion of the packing container, thereby closing the packing container, in said lowered position said stiffening ring being disposed substantially below said first lever arms, and a raised position during which said first lever arms are downwardly oriented and spaced from the flanged mouth portion of the packing container, in said raised position said stiffening ring being disposed above said first lever arms to allow said cap body to be moved and to allow the packing container to be opened.

7. The closing arrangement of claim 6 wherein said first lever arms of said levers are shorter than said second lever arms of said levers and wherein each first lever arm has a length greater than a distance between said fulcrum and a point of application of each first lever arm on the packing container.

8. The closure cap of claim 6 wherein each of said levers has an upwardly directed projection with a plane surface which is in a substantially horizontal orientation when said first lever arm is spaced from the flanged mouth portion of the packing container, said plane surface being in a substantially vertical orientation and resting against an inside periphery of said stiffening ring when said first lever arm cooperates with the flanged mouth portion of the packing container.

9. The closing arrangement of claim 6 wherein said stiffening ring has a smaller diameter in said raised position than in said lowered position and wherein said stiffening ring in said raised position has a smaller diameter than a diameter of a circle formed by said hinges of said locking levers when said locking levers form angles of substantially 90° with a longitudinal axis of the closure cap.

10. The closing arrangement of claim 6 wherein said levers are hinged to a middle portion of said stiffening ring.

* * * * *